US007234426B2

(12) United States Patent
Murata

(10) Patent No.: US 7,234,426 B2
(45) Date of Patent: Jun. 26, 2007

(54) VARIABLE VALVE APPARATUS OF INTERNAL COMBUSTION ENGINE

(75) Inventor: Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/452,265

(22) Filed: Jun. 14, 2006

(65) Prior Publication Data

US 2006/0283415 A1 Dec. 21, 2006

(30) Foreign Application Priority Data

Jun. 15, 2005 (JP) ..... 2005-175223

(51) Int. Cl.
*F01L 1/34* (2006.01)

(52) U.S. Cl. ..... 123/90.16; 123/90.15; 123/90.6; 123/90.31

(58) Field of Classification Search ..... 123/90.16, 123/90.15, 90.6, 90.31
See application file for complete search history.

(56) References Cited

U.S. PATENT DOCUMENTS 6,959,674 B2 * 11/2005 Fischer ..... 123/90.16

FOREIGN PATENT DOCUMENTS

JP 2003-239712 A 8/2003

* cited by examiner

*Primary Examiner*—Thomas Denion
*Assistant Examiner*—Zelalem Eshete
(74) *Attorney, Agent, or Firm*—Birch, Stewart, Kolasch & Birch, LLP

(57) ABSTRACT

A variable valve apparatus of an internal combustion engine adopts a structure in which, a transmission arm is laid out such that, when a distance from a contact point where a cam contacts a transmission arm to an oscillating fulcrum of the transmission arm is defined as A, and a distance from the oscillating fulcrum of the transmission arm to a point of action of the transmission arm is defined as B to thereby determine a B/A value, θ1 as a B/A value at the time of a high valve lift control for controlling valve lift characteristics, and θ2 as a B/A value at the time of a low valve lift control for controlling valve lift characteristics establish a relation of θ1>θ2.

6 Claims, 15 Drawing Sheets

· A1 < B1

· B1/A1 = θ1

VARIABLE VALVE APPARATUS OF INTERNAL COMBUSTION ENGINE

BACKGROUND OF THE INVENTION

1. Field of the Invention

The present invention relates to a variable valve apparatus of an internal combustion engine, which varies the phase of an intake valve or an exhaust valve.

2. Description of the Related Art

Many reciprocating engines mounted in automobiles include a variable valve apparatus for changing the phases of an intake valve and an exhaust valve, for reasons of engine gas emission countermeasures, fuel consumption reduction and the like.

Many of such variable valve apparatuses employ a structure in which the phase of a cam formed on a camshaft is replaced with an oscillating cam in which a base circular zone and a lift zone are ranging. Specifically, a structure is employed in which an oscillating range of the oscillating cam is changed, whereby a valve opening period and a valve lift amount of the intake valve and the exhaust valve driven via a rocker arm are varied continuously.

In order to improve a pumping loss, a structure is proposed in Jpn. Pat. Appln. KOKAI Publication No. 2003-239712 in which a transmission arm is interposed between a cam and an oscillating cam, and the transmission arm is oscillatably supported by a control shaft.

Specifically, the transmission arm is moved by the turning displacement of the control shaft. A contact position where the transmission arm contacts the cam is changed by moving the transmission arm. By changing the contact position of the transmission arm and the cam, the valve characteristics, that is, a valve opening period, valve open-close timing and a valve lift volume are continuously varied.

In such a variable valve apparatus, it is desired that a variable range from a high valve lift to a low valve lift is expanded.

However, it is difficult to expand the variable range of the valve characteristics. In particular, in the case of a variable valve apparatus in which a transmission arm is moved, a range to move the transmission arm is limited in terms of the supporting structure of the transmission arm, and further regulated by devices and components arranged around the transmission arm. For this reason, it is difficult to expand the variable range easily.

BRIEF SUMMARY OF THE INVENTION

Accordingly, an object of the present invention is to provide a variable valve apparatus of an internal combustion engine, having a simple structure and capable of expanding a variable range of valve characteristics.

In order to achieve the above object, in a variable valve apparatus of internal combustion engine according to the invention, a transmission arm is laid out such that, when a distance from a contact point between a cam and the transmission arm to an oscillating fulcrum of the transmission arm is defined as A, and a distance from the oscillating fulcrum of the transmission arm to a point of action of the transmission arm is defined as B to thereby determine a B/A value, $\theta 1$ as a B/A value at the time of a high valve lift control for controlling valve lift characteristics, and $\theta 2$ as a B/A value at the time of a low valve lift control for controlling valve lift characteristics establish a relation of $\theta 1 > \theta 2$.

In this structure, an oscillation angle of the oscillating cam can be made larger than in the case depending upon only a cam profile at the high valve lift side in the variable range by use of a lever ratio (leverage) that changes according to operations at a high valve lift control to a low valve lift control. Further, at the low valve lift side in the variable range, the oscillation angle can be made smaller than in the case depending upon only the cam profile. Namely, while the movement range of the transmission arm is left as it is, a higher valve lift amount can be obtained at the high valve lift side, and a smaller valve lift amount can be obtained at the low valve lift side.

Therefore, without need to change cams, or change the movement range of the transmission arm, it is possible to expand the variable range of the valve characteristics by a simple structure only to set the layout of the transmission arm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of embodiments given below, serve to explain the principles of the invention.

DETAILED DESCRIPTION OF THE INVENTION

A variable valve apparatus according to a first embodiment of the present invention will be explained with reference to FIGS. 1 to 9 hereinafter.

Figure 1:
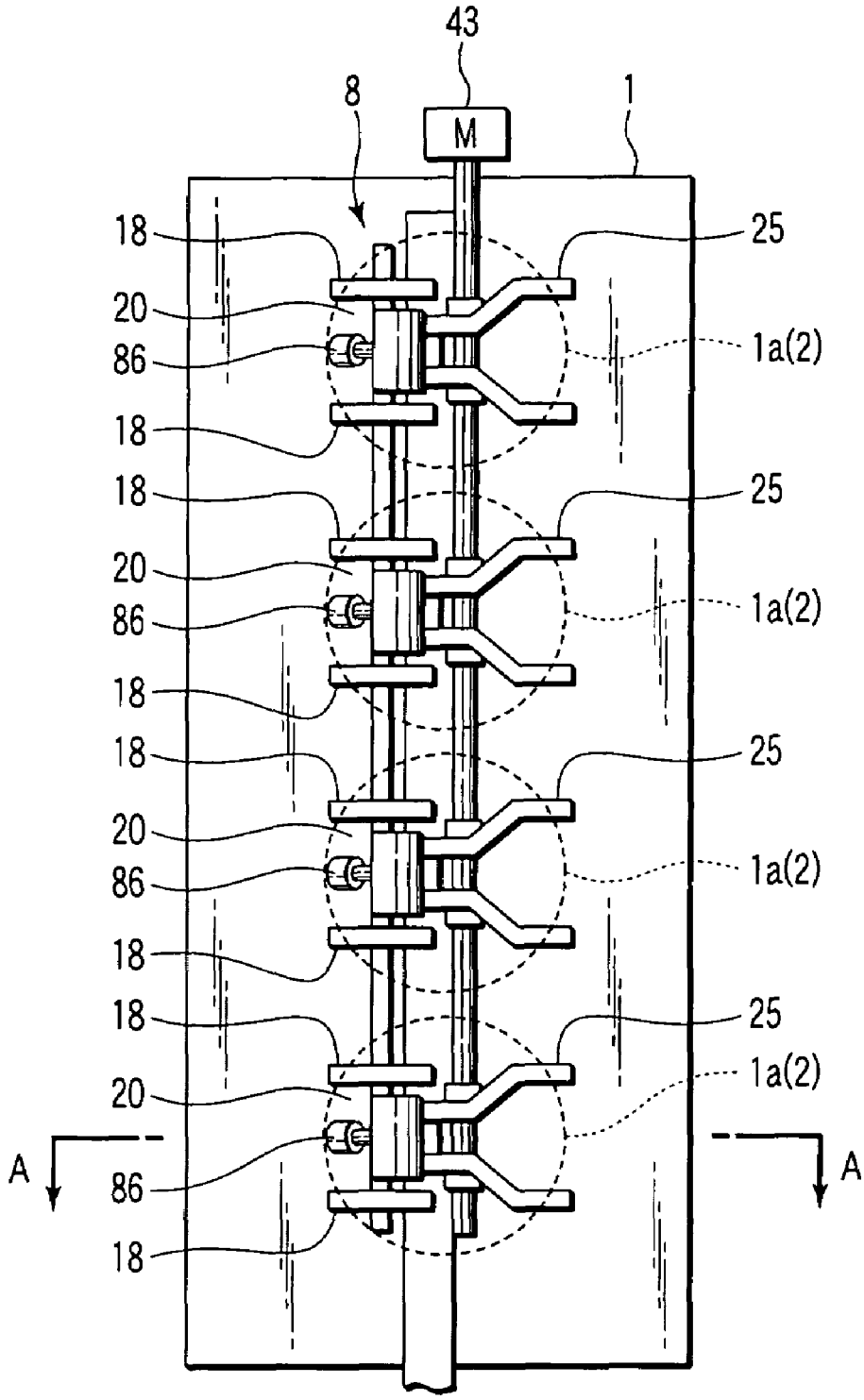
FIG. 1 is a plan view showing a cylinder head having mounted thereon a variable valve apparatus according to a first embodiment of the present invention.
Figure 2:
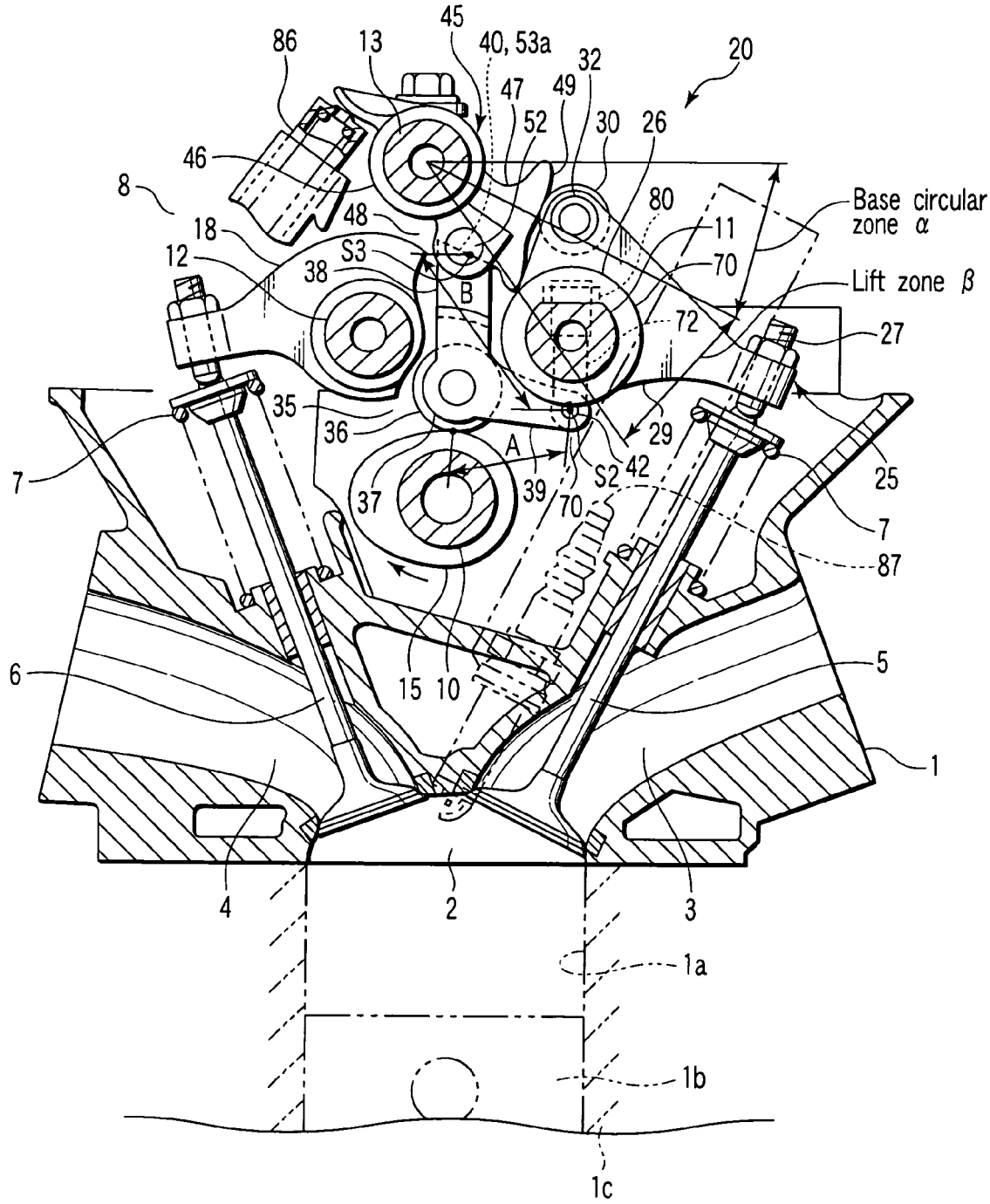
FIG. 2 is a cross sectional view showing the variable valve apparatus and the cylinder head taken along line A—A in FIG. 1.
Figure 3:
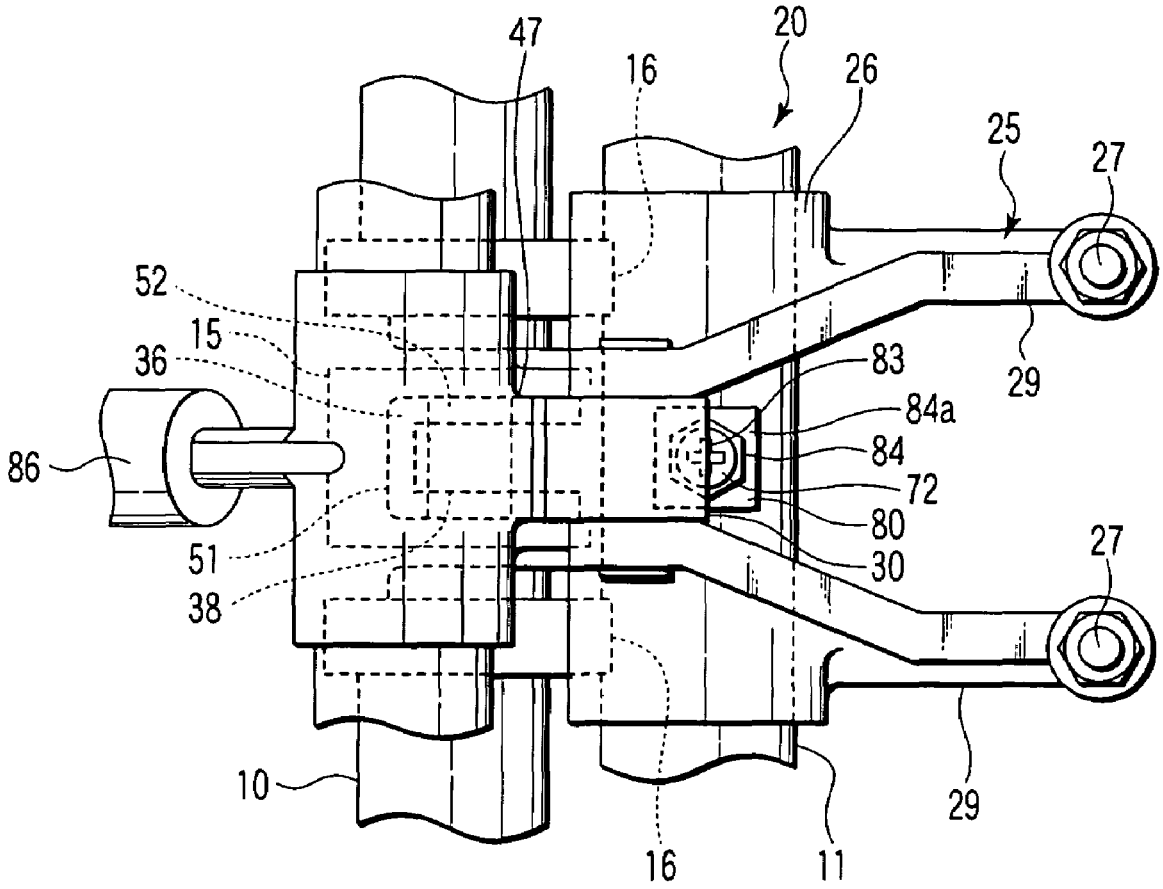
FIG. 3 is a plan view showing the variable valve apparatus shown in FIG. 2.
Figure 4:
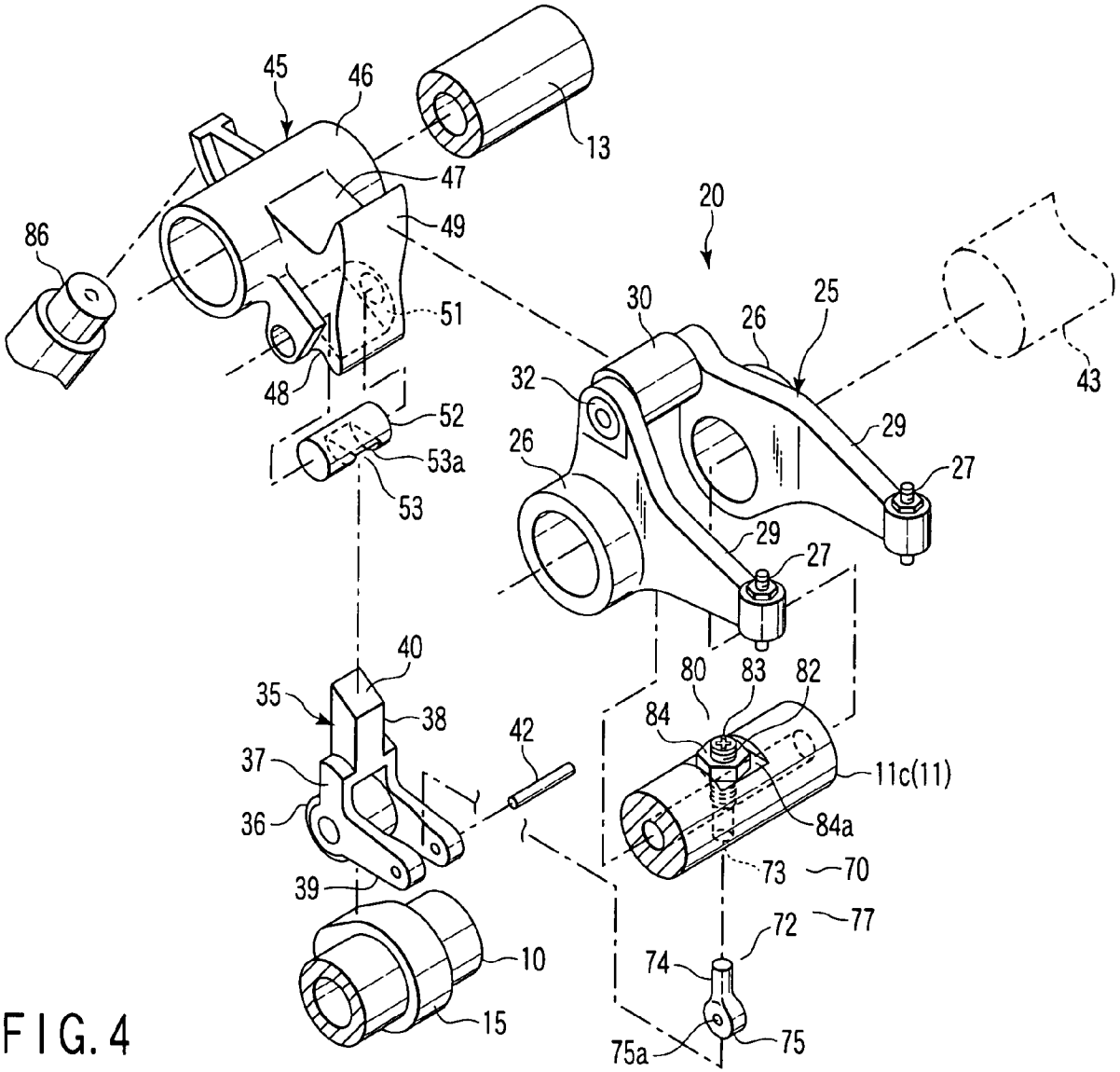
FIG. 4 is an exploded perspective view showing the variable valve apparatus shown in FIG. 2.

FIG. 1 is a plan view of a cylinder head 1 of a multi-cylinder internal combustion engine, for example, a 4-cylinder reciprocating gasoline engine 100 with cylinders 1*a* arranged in series. FIG. 2 is a detailed cross sectional view of the cylinder head 1 taken along line A—A shown in FIG. 1. FIG. 3 is a plan view showing a part of the cylinder head 1 enlarged. FIG. 4 is an exploded view of a variable valve apparatus 20 mounted on the cylinder head 1.

The cylinder head 1 will be explained with reference to FIGS. 1 to 3. On a lower surface of the cylinder head 1, combustion chambers 2 are formed, respectively, in the wake of four cylinders 1*a* formed in a cylinder block 1*c* and arranged in series. Note that combustion chamber 2 is illustrated only one in the figure.

For example, two pieces each of intake port 3 and exhaust port 4, that is, one pair of intake port 3 and exhaust port 4 are formed in the combustion chambers 2. An intake valve 5 that opens and closes the intake port 3 and an exhaust valve 6 that opens and closes the exhaust port 4 are assembled on the top of the cylinder head 1. For the intake valve 5 and the exhaust valve 6, a normally closed reciprocating valve which is energized in the closing direction by a valve spring 7 is used, respectively. Note that a piston 1*b* is reciprocatively housed in the cylinder 1*a*. The piston 1*b* is illustrated by chain two-dot, dashed line in FIG. 2.

In FIGS. 1 and 2, reference numeral 8 denotes, for example, a Single Overhead Camshaft (SOHC) type valve operating system mounted on the upper part of the cylinder head 1. The valve operating system 8 drives the intake valve 5 and exhaust valve 6. The SOHC type valve operating system 8 is a valve operating system that drives the intake valve 5 and the exhaust 6 by one cam shaft 10.

Reference numeral 10 denotes a camshaft rotatably arranged in the longitudinal direction of the cylinder head 1 on the top of the combustion chamber 2. Reference numeral 11 denotes a rocker shaft on the intake side rotatably arranged in intake port side with which the camshaft 10 is sandwiched. The rocker shaft 11 is also used as a control shaft of the present application.

Reference numeral 12 is a rocker shaft on the exhaust side arranged and fixed on the exhaust port side. Reference numeral 13 denotes a support shaft lying above the rocker shaft 11 and 12 and located closer to the rocker shaft 12 than to the rocker shaft 11. Rocker shafts 11 and 12 and the support shaft 13 are all configured by shaft members arranged in parallel to the camshaft 10.

The camshaft 10 is rotatably driven along the arrow-mark direction of FIG. 2 by an output from a crankshaft of the engine. Note that the crankshaft is not shown. As shown in FIG. 2, to each part of the camshaft 10, an intake cam 15 and two exhaust cams 16 are formed for each combustion chamber 2, that is, for each cylinder. The intake cam 15 is corresponding to the cam of the present invention. The intake cam 15 is arranged at the overhead center of the combustion chamber 2. The exhaust cams 16 and 16 are arranged on both sides of the intake cam 15, respectively.

To the exhaust-side rocker shaft 12, a rocker arm 18 for exhaust valve is rotatably supported for each exhaust cam 16, that is, each exhaust valve 6 as shown in FIGS. 1 and 2. In addition, to the intake side rocker shaft 11, a variable valve apparatus 20 is assembled for each pair of intake cams 15, that is, for each pair of intake valves.

The rocker arm 18 transmits displacement of the exhaust cam 16 to the exhaust valve 6. The variable valve apparatus 20 transmits displacement of the intake cam 15 to the intake valves 5 and 5. Due to the rocker arm 18 and the variable valve apparatus 20 being driven by each cam 15 and 16, predetermined combustion cycles, for example, four strokes of intake stroke, compression stroke, explosion stroke and exhaust stroke, are formed in the cylinder 1*a* in linkage with the reciprocating motion of the piston 1*b*. Note that reference numeral 87 in FIG. 2 denotes an ignition plug to ignite fuel-air mixture in the combustion chamber 2.

As shown in FIGS. 1 to 4, the apparatus 20 comprise a rocker arm 25, center rocker arm 35, a swing arm 45 and a support mechanism 70.

The rocker arm 25 is oscillatably supported by the rocker shaft. The swing cam 45 is combined with the rocker arm 25. The swing cam 45 is equivalent to the oscillating cam of the present invention.

The center rocker arm 35 transmits displacement of the intake cam 15 to the swing cam 45. The center rocker arm 35 is equivalent to the transmission arm of the present invention. The support mechanism 70 oscillatably supports the center rocker arm 35 to the rocker arm 11.

As shown in FIGS. 3 and 4, the rocker arm 25 is, for example, bifurcate. Specifically the rocker arm 25 has a pair of rocker shaft arm pieces 29 and a roller member 30. A cylindrical rocker shaft supporting boss 26 is formed at the center of the each rocker arm piece 29.

To one side of the each rocker arm piece 29, adjust screw unit 27 which drives the intake valve is assembled. The roller member 30 is sandwiched between other ends of the rocker arm pieces 29. The roller member 30 is a contact unit of the present invention.

Note that reference numeral 32 denotes a short shaft to rotatably pivot the roller member 30 to the rocker arm piece 29. The rocker shaft 11 is inserted in the bosses 26 and can oscillate. The roller member 30 is arranged on the support shaft 13 side, namely on the center side of the cylinder head 1.

The adjust screw units 27 are arranged at the upper ends of the intake valves 5, that is, valve stem end of the intake valve 5, respectively. When the rocker arm 25 oscillates around the rocker shaft 11, the intake valves 5 are driven.

As shown in FIGS. 2 to 4, the swing cam 45 has a boss portion 46, an arm portion 47, and a receiving unit 48. The boss portion 46 is cylindrical. The support shaft 13 is inserted into the boss portion 46 and rotatably fitted.

The arm portion 47 extends from the boss portion 46 to the roller member 30, that is, rocker shaft. The receiving unit 48 is formed at the lower part of the arm portion 47.

The front end surface of the arm portion 47 is a cam surface 49 which transmits displacement to the rocker arm 25. The cam surface 49 extends in the vertical direction. The cam surface 49 is brought rotatably in contact with the outer circumferential surface of the roller member 30 of the rocker arm 25. The detail of the cam surface 49 will be described later.

As shown in FIG. 4, the receiving unit 48 comprises a recessed portion 51 and a short shaft 52. The recessed portion 51 is formed at the lower surface portion of the lower part of the arm portion 47 which is directly above the camshaft 10.

The short shaft 52 is rotatably supported in the recessed portion 51 in the same direction as that of the camshaft 10.

Note that reference numeral 53 denotes a recessed portion which is formed on the outer circumference of the short shaft 52 portion and has a flat bottom surface.

As shown in FIGS. 2 and 4, to the center rocker arm 35, a substantially L-shape member is used. The center rocker arm 35 has a rotary contact element, for example, a cam follower 36 which comes rotatably in contact with the cam surface of the intake cam 15, and frame-shape holder unit 37 which rotatably supports the cam follower 36.

Specifically, the center rocker arm 35 has a relay arm portion 38 and a fulcrum arm portion 39. The relay arm portion 38 extends from the holder unit 37 towards between the upper rocker shaft 11 and the support shaft 13.

As shown in FIGS. 5 to 8, the fulcrum arm portion 39 extends from the holder unit 37 to the bottom side of a shaft portion 11*c* of the rocker shaft 11. The shaft portion 11*c* is exposed from between the pair of rocker arm pieces 29. The fulcrum arm portion 39 is, for example, bifurcated.

To the front end, i.e. top end surface, of the relay arm portion 38, a gradient surface 40 is formed as a drive surface. The gradient surface 40 tilts in such a manner that the rocker shaft 11 side is lower and the support shaft 13 side is higher. The front end of the relay arm portion 38 is inserted into the recessed portion 53 of the swing cam 45. With this, the center rocker arm 35 is interposed between the intake cam 15 and the swing cam 45. The gradient surface 40 of the arm portion 38 is slidably abutted on a receiving surface 53*a* formed at the bottom surface of the recessed portion 53. The receiving surface 53*a* is a driven surface. By this, displacement of the intake cam 15 is transmitted to the swing cam 45 from the relay arm portion 38 while being accompanied by slides.

As shown in FIGS. 2 and 4, the support mechanism 70 has a support unit 77 and an adjusting unit 80. The support unit 77 has a control arm 72. The control arm 72 oscillatably supports the center rocker arm 35. The adjusting unit 80 adjusts the position of the center rocker arm 35.

Now, the support unit 77 will be explained. A through hole 73 is formed on a lower peripheral wall of the shaft portion 11*c*. The through hole portion 11 extends in a direction orthogonal to the center of axle of the shaft portion 11*c*. The control arm 72 is formed to have a rod portion 74 having a circular cross section, a disk-shaped pin joining piece 75 formed on one end of the rod portion 74, and a support hole 75*a* formed on the pin joining piece 75. The support hole 75*a* is shown in FIG. 4.

The end of the rod portion 74 is inserted into the through hole 73 from the bottom of the shaft portion 11*c*. Note that the inserted rod portion 74 can move in the axial direction and rotate in the circumferential direction. The end of the rod portion 74 impinges against a component of the adjusting unit 80 described later.

The pin joining piece 75 is inserted in the fulcrum arm portion 39. A pin 42 is inserted in the arm portion 39 and the support hole 75*a*, thereby allowing the front end of the fulcrum arm portion 39 and the end of the control arm 72 protruding from the shaft portion 11*c* to rotatably join each other in the protruding direction, that is, direction orthogonal to the center of axle of the camshaft 10 of the intake cam 15.

By this joining, when the intake cam 15 rotates, the center rocker arm 35 is oscillated vertically with the pin 42 as the fulcrum. That is, the center rocker shaft 35 is oscillatably supported. That is, the center rocker arm 35 is oscillatably supported.

In linkage with the motion of the center rocker arm 35, the swing cam 45 is periodically oscillated with the support shaft 13 used as the fulcrum, the short shaft 52 used as the point of action, that is, point at which a load from the center rocker arm 35 works on, and the cam surface 49 used as the point of force, that is, as point at which the rocker arm 25 is driven.

Note that the swing arm 45 is energized by a pusher 86 as one example of energizing means such that the center rocker arm 35 is pushed against the intake cam 15. Therefore, the rocker arm 25, the center rocker arm 35 and the swing cam 45 come in contact to each other. The pusher 86 has built-in spring.

The pusher 86 is used to compensate the energize force which works on the swing cam 45 during the cam follower 36 and the intake cam 15 rotatably contacting each other, namely, during the swing cam 45 being not oscillated. Because, when the base circle of the intake cam 15 and the cam follower 36 rotatably contact with each other, namely, when the swing cam 45 is not oscillated, a spring force of the valve spring 7 does not work.

As shown in FIGS. 1 and 4, for example, a control motor 43 as an actuator is connected to the end of the rocker shaft 11. The rocker shaft 11 is driven, or rotated around the center of axle by the control motor 43. By this rotation of the rocker shaft 11, the control arm 72 can be varied from a substantially perpendicular posture shown in, for example, FIGS. 5 and 6 to a posture greatly tilted to the camshaft rotating direction shown in FIGS. 7 and 8.

The center rocker arm 35 is moved, that is, displaced in the direction intersecting with the axial direction of the shaft portion 11*c* by this change of posture of the control arm 72. That is, as shown in FIGS. 5 to 8, the position at which the follower rolling intake contact cam follower 36 and the intake cam 15 can be varied in the early injection directions or the late injection direction.

Because the rotary contact position is variable, the posture of the cam surface 49 of the swing cam 45 is varied too. That can simultaneously and continuously vary an opening and closing timing, a valve opening period, and a valve lift volume of the intake valve 5.

Specifically, a curvature which varies the distance from the center of, for example, the support shaft 13 is used for the cam surface 49. As shown in FIG. 2, the cam surface 49 has a base circular zone $\alpha$ and a lift zone $\beta$. The circular zone $\alpha$ is the upper part of the cam surface 49. The base circular zone $\alpha$ is a circular arc surface centering around the center of axle of the support shaft 13.

The lift zone $\beta$ is a lower part of the cam surface 49. The lift zone $\beta$ has a first portion $\gamma$1 and a second portion $\gamma$2. The first portion $\gamma$1 extends from the base circular zone $\alpha$ and curves the opposite direction opposite to the direction in which base circular zone $\alpha$ curves. The second portion $\gamma$2 extends from the first portion $\gamma$1. The second portion $\gamma$2 curves in the opposite direction opposite to the direction in which the first portion γ1 curves. Specifically, the base lift zone β is a circular arc surface similar to a cam shape of a lift area of, for example, the intake cam 15.

The oscillating range of the swing cam 45 is varied when rotary contact position where the cam follower 36 rotary contacts the intake cam 15 is displaced in the early or late injection direction of the intake cam 15. When the oscillating range of the swing cam 45 is varied, the region of the cam surface 49 with which the roller member 30 comes in contact is varied. More specifically, it is intended that the ratio of the base circular zone α and the lift zone β where the roller member 30 comes and goes is varied while the phase of the intake cam 15 is shifted to the early injection direction or late injection direction.

To the adjusting unit 80, a structure to support the end of the inserted control arm 72 by a screw member 82 is adopted as shown in FIGS. 2 to 4. Specifically, the screw member 82 is screwed from a point that is opposite to through hole 73 in the shaft portion 11*c* in such a manner as to freely advance and retreat. That is, the screw member 82 is screwed from upper peripheral wall of the shaft portion 11*c*. The insertion end of the screw member 82 impinges against the end of the control arm 72 halfway in the passage 73 and supports the control arm 72.

As a consequence, operating to rotate the screw member 81 varies the protrusion rate of the rod portion 74 protruding from the shaft member 11*c*. The volume of the protruding portion of the rod portion 74 is varied. When the protrusion rate of the rod portion 74 is varied, the rotary contact position of the cam follower 36 with which the intake cam 15 comes in contact is varied. On the basis of the changes of the rotary contact position of the cam follower 36 with which the intake cam 15 comes in contact, valve opening time and the valve closing time of the intake valve 5 are adjusted.

Reference numeral 83 denotes, for example, a cruciform groove formed on the top end surface of the screw member 82 to operate to rotate the screw member 82. Reference numeral 84 denotes a lock nut in which the end of the screw member 82 is screwed. Reference numeral 84*a* denotes a notch which forms a bearing surface of the lock nut 84.

On the other hand, for the center rocker arm 35, contrivance is made to expanding the variable range of the valve characteristics of the intake valve 5. To this contrivance, a structure is employed in which the center rocker arm 35 is arranged such that the lever ratio (leverage) is changed at the high valve lift side and the low valve lift side.

To explain this structure more specifically, a B/A value is determined as shown in FIG. 2, wherein A is a distance from a contact point S1 between the intake cam 15 and the cam follower 36 of the center rocker arm 35 to an oscillating fulcrum S2 of the center rocker arm 35, namely, the center of the pin 42, and B is a distance from the oscillating fulcrum S2 of the center rocker arm 35 to a point of action S3 of the center rocker arm 35, namely, the point which transmits the cam displacement to the swing cam 45. The center rocker arm 35 is laid out such that this value becomes larger at the high valve lift control moment than at the low valve lift control moment.

Figure 5:
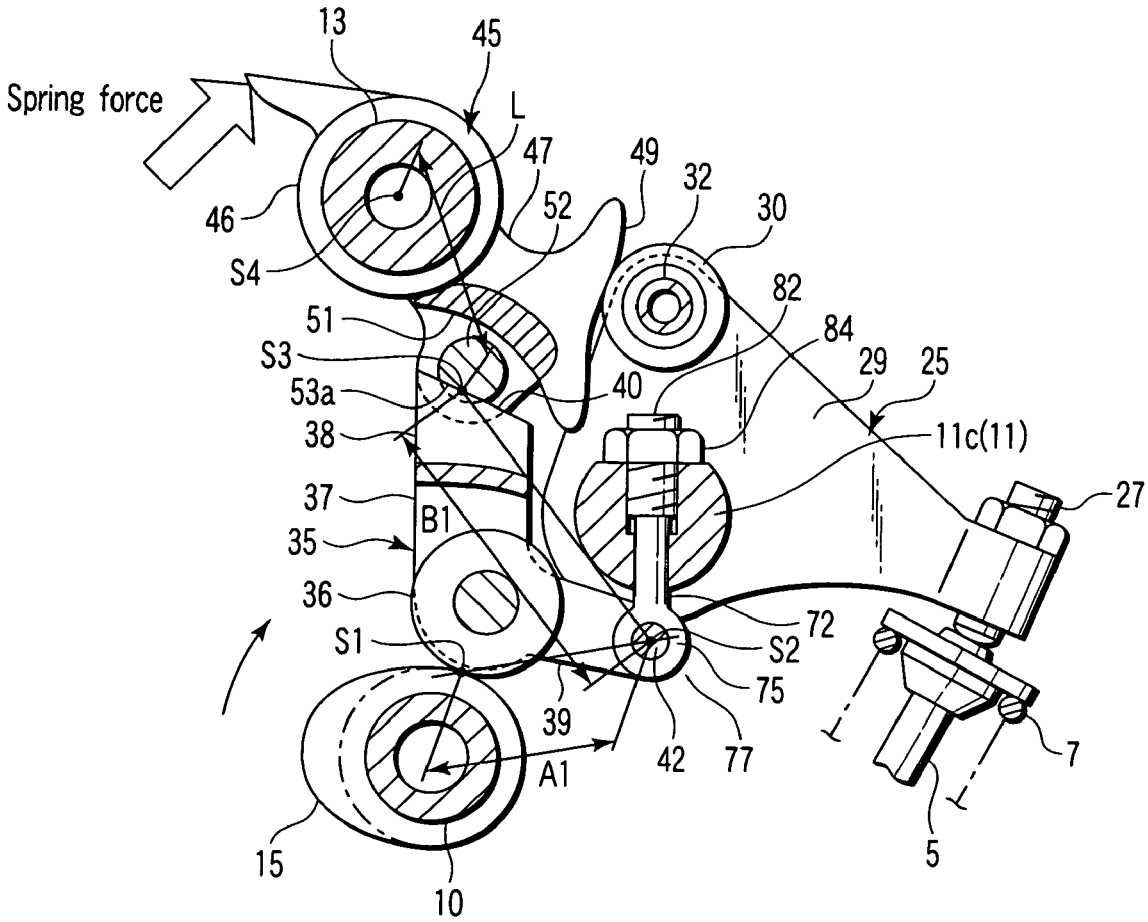
FIG. 5 is a cross sectional view showing a state where a rocker arm contacts a base circular zone of a cam surface at the maximum valve lift control of the variable valve apparatus shown in FIG. 2.

As shown in, for example, FIG. 5, at the high valve lift control moment, a distance between the contact point S1 and the oscillating fulcrum S2 is defined as A1, and a distance between the oscillating fulcrum S2 and the point of action S3 is defined as B1, and thereby a B1/A1 value is made θ1. As shown in, for example, FIG. 7, at the low valve lift control moment, a distance between the contact point S1 and the oscillating fulcrum S2 is defined as A2, and a distance between the oscillating fulcrum S2 and the point of action S3 is defined as B2, and thereby a B2/A2 value is made θ2. The center rocker arm 35 is arranged such that a relation of θ1>θ2, namely, B1/A1 value>B2/A2 value is established. Note that its stands that A (A1, A2)<B (B1, B2).

Next, with reference to FIGS. 5 to 8, the action brought about by such a layout of the center rocker arm 35 will be explained together with the action of the variable valve apparatus 20.

Now, assume that the camshaft 10 is rotated by the operation of an engine as shown in the arrow mark direction of FIG. 2.

In this case, the cam follower 36 of the center rocker arm 35 contacts the intake cam 15 and is tracer-driven by the cam profile of the cam 15. By this, the center rocker arm 35 oscillates in the vertical direction with the pin 42 set as the oscillating fulcrum.

The receiving surface 53*a* of the swing cam 45 is transmitted the oscillation displacement of the center rocker arm 35 through the gradient surface 40. Now, since the receiving surface 53*a* and the gradient surface 40 are slidable, the swing cam 45 repeats oscillating movement of being pressed up or lowered by the gradient surface 40 while sliding on the gradient surface 40. Oscillation of the swing cam 45 allows the cam surface 49 to reciprocate in the vertical direction.

Because, the cam surface 49 is rotatably in contact with the roller member 30 of the rocker arm 25, the roller member 30 is periodically pressed by the cam surface 49. The rocker arm 25 oscillates when pressure is applied thereto, and opens or closes the pair of intake valves 5, with the rocker shaft 11 as a support point.

Now, assume that the engine is operated at a high speed by operation of an accelerator pedal. After the motor 43 as a actuator receives acceleration signal, the motor 43 rotates the rocker shaft 11 and rotates the control arm 72 to the spot where, for example, the maximum valve lift volume is secured, for example, where the control arm 72 achieves the vertical posture as shown in FIGS. 5 and 6.

By this valve lift control, then, the center rocker arm 35 displaces along the rotating direction on the intake cam 15 in response to the rotation of the control arm 72. As a consequence, the position where the center rocker arm 35 comes in rotary contact with the intake cam 15 is deviated in the early or late injection direction on the intake cam 15. Therefore the cam face 49 of the swing cam 45 fixed to the position where the cam surface 49 of the swing cam 45 achieves an angle close to perpendicularity as shown in FIGS. 5 and 6.

Figure 6:
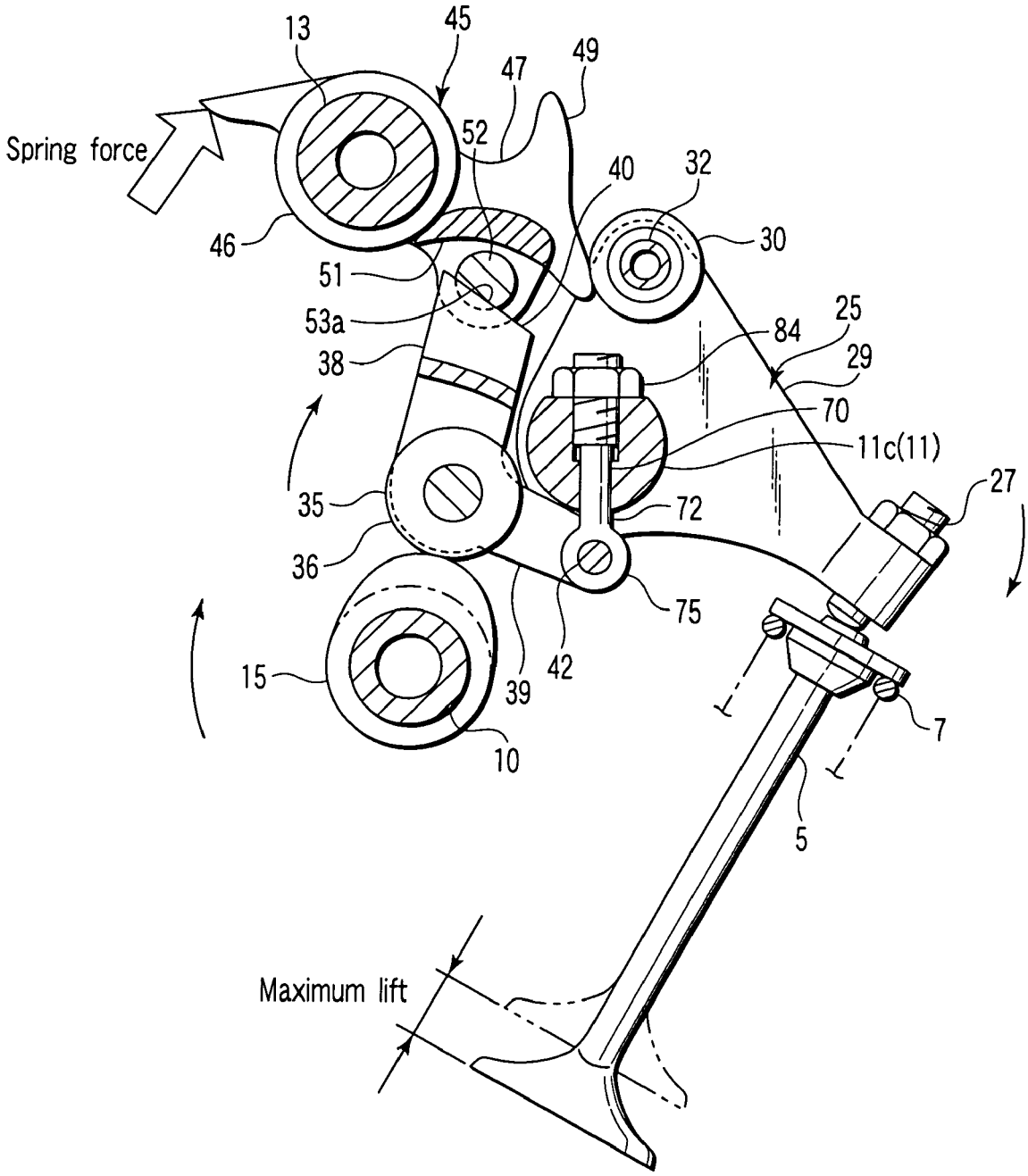
FIG. 6 is a cross sectional view showing a state where the rocker arm shown in FIG. 2 contacts a lift zone of the cam surface at a high lift control of the variable valve apparatus.

As shown in FIGS. 5 and 6, by the posture of the cam surface 49, a region where the roller member 30 of the cam surface 49 comes and goes is set to a region which brings the maximum valve lift volume, that is, to the shortest base circular zone a and the longest lift zone β. That is, the rocker arm 25 is driven by the cam surface portion made by the narrow base circular zone α and the longest lift zone β. Consequently, the intake valve 5 is opened and closed at the maximum valve lift volume as shown in the graph of A1 of, for example, FIG. 9, and further, at an opening and closing timing that follows the intake stroke.

As shown in FIG. 5, the B1/A1 value (θ1) is set to a value that becomes larger than the B2/A2 value at the low valve lift control.

When the rotary contact position between the cam follower 36 of the center rocker arm 35 and the intake cam 15 changes, the distance A from the contact point S1 to the oscillating fulcrum S2 becomes longer. However, when the center rocker arm 35 moves, the distance B, from the contact point S2 to the point of action S3, becomes longer. The change in the distance B is larger than the change in the distance A.

That is, at the high valve lift control, the distance B1 from the contact point S1 to the oscillating fulcrum S2 becomes longer than that of the low valve lift control. Consequently, the cam displacement is enlarged and is transmitted to the swing cam 45. Consequently maximum valve lift volume becomes large.

At the point where the maximum valve lift amount is attained, the largest lever ratio (leverage), herein, B1/A1>1 is obtained. Accordingly, the swing cam 45 oscillates by a larger degree than in the case depending upon only the cam profile of the intake cam 15. That is, the intake valve 5 secures a higher valve lift amount than that at the time when it is regulated by the cam profile.

Figure 7:
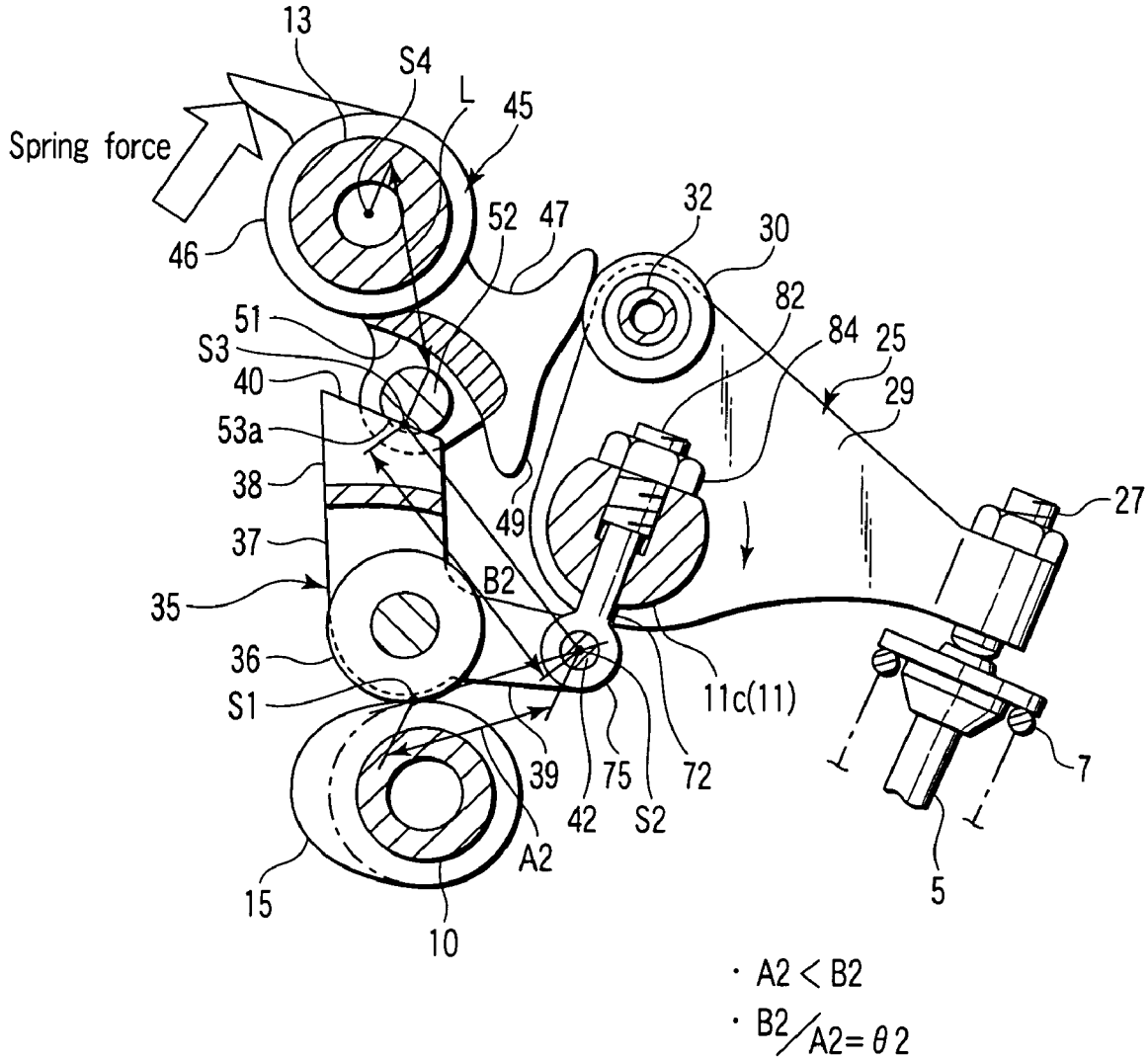
FIG. 7 is a cross sectional view showing a state where the rocker arm contacts the base circular zone of the cam surface at the minimum valve lift control of the variable valve apparatus shown in FIG. 2.
Figure 8:
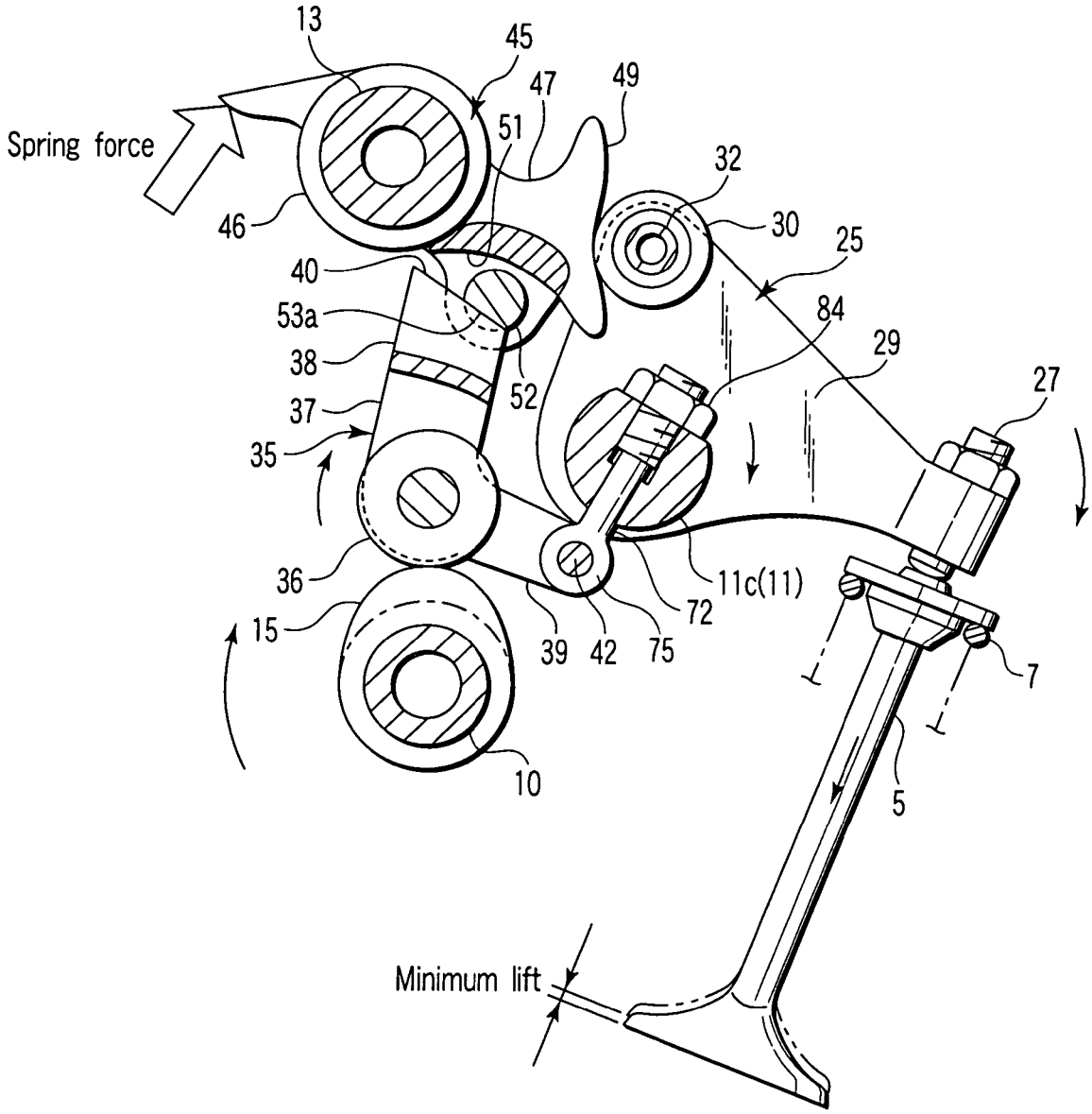
FIG. 8 is a cross sectional view showing a state where the rocker arm contacts a lift zone of the cam surface at the minimum valve lift control of the variable valve apparatus shown in FIG. 2.

In addition, when low and medium rotating operations are carried out, the drive of the control motor 43 rotates the rocker shaft 11 in the direction in which the pin 42 close to the intake cam 15 as shown in FIGS. 7 and 8. Then, in response to the rotation of the rocker shaft 11, the center rocker arm 35 moves on the intake cam 15 to the front side of the rotating direction.

As a result, the rotary contact position between the center rocker arm 35 and the intake cam 15 is deviated in the early injection direction on the intake cam 15 as shown in FIGS. 7 and 8. By the change of this rotary contact position, the valve opening time of the cam phase is quickened. In addition, the gradient surface 40 slides from the initial position to the early injection direction on the receiving surface 53*a* in response to the shift of the center rocker arm 35.

By the shift of the center rocker arm 35 in this case, the swing cam 45 changes the posture to have the cam surface 49 tilted to the down side as shown in FIGS. 7 and 8. As the gradient increases, the region of the cam surface 49 in which the roller member 30 comes and goes is changed to a region in which the base circular zone α gradually increases and the lift zone β gradually decreases.

As the cam profile of the varied cam surface 49 is being transmitted to the roller member 30, the rocker arm 25 is oscillatably driven while the valve opening time is quickened.

Herein, the B2/A2 value (θ2) is set to a value that becomes smaller than that (B1/A1 value) at the high valve lift control as shown in FIG. 7.

At this time, the distance A from the contact point S1 to the oscillating fulcrum S2 becomes shorter in response to the change of the rotary contact position between the intake cam 15 and the cam follower 36. However, when the center rocker arm 35 moves, the distance B, from the contact point S2 to the point of action S3, becomes shorter. The change in the distance B is larger than the change in the distance A. At a point where the minimum valve lift amount is attained, the smallest lever ratio (leverage), herein, B2/A2 is obtained. Accordingly, the swing cam 45 oscillates by a smaller degree than in the case depending upon only the cam profile of the intake cam 15. That is, the intake valve 5 secures a lower valve lift amount than that at the time when it is regulated by the cam profile.

Figure 9:
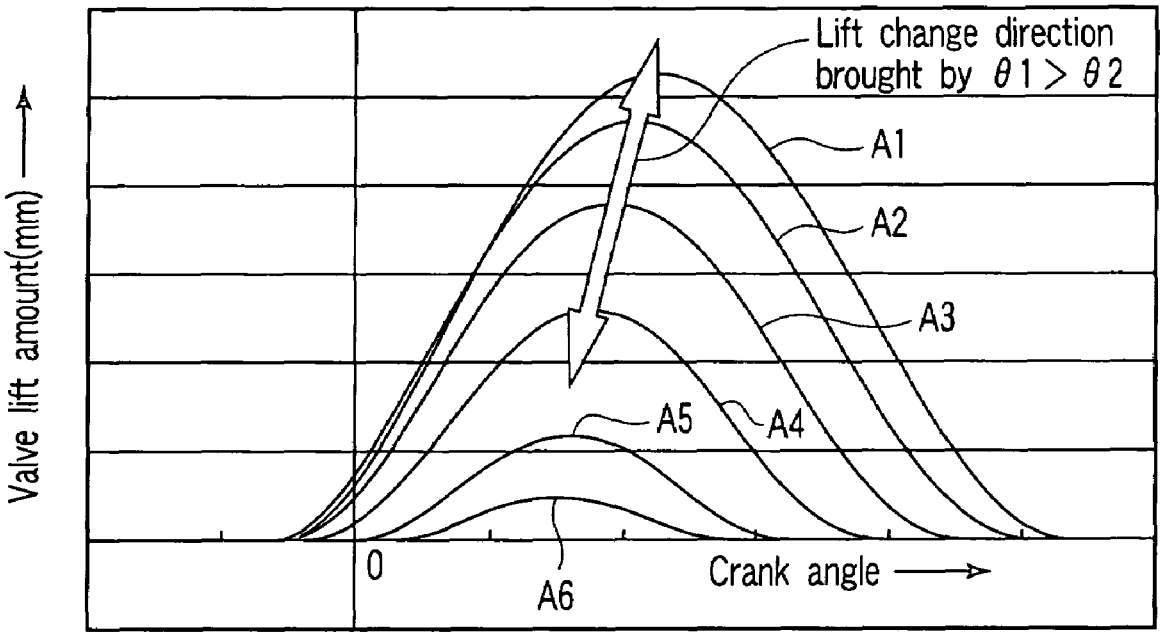
FIG. 9 is a graph showing performances of the variable valve apparatus shown in FIG. 2.
Figure 10:
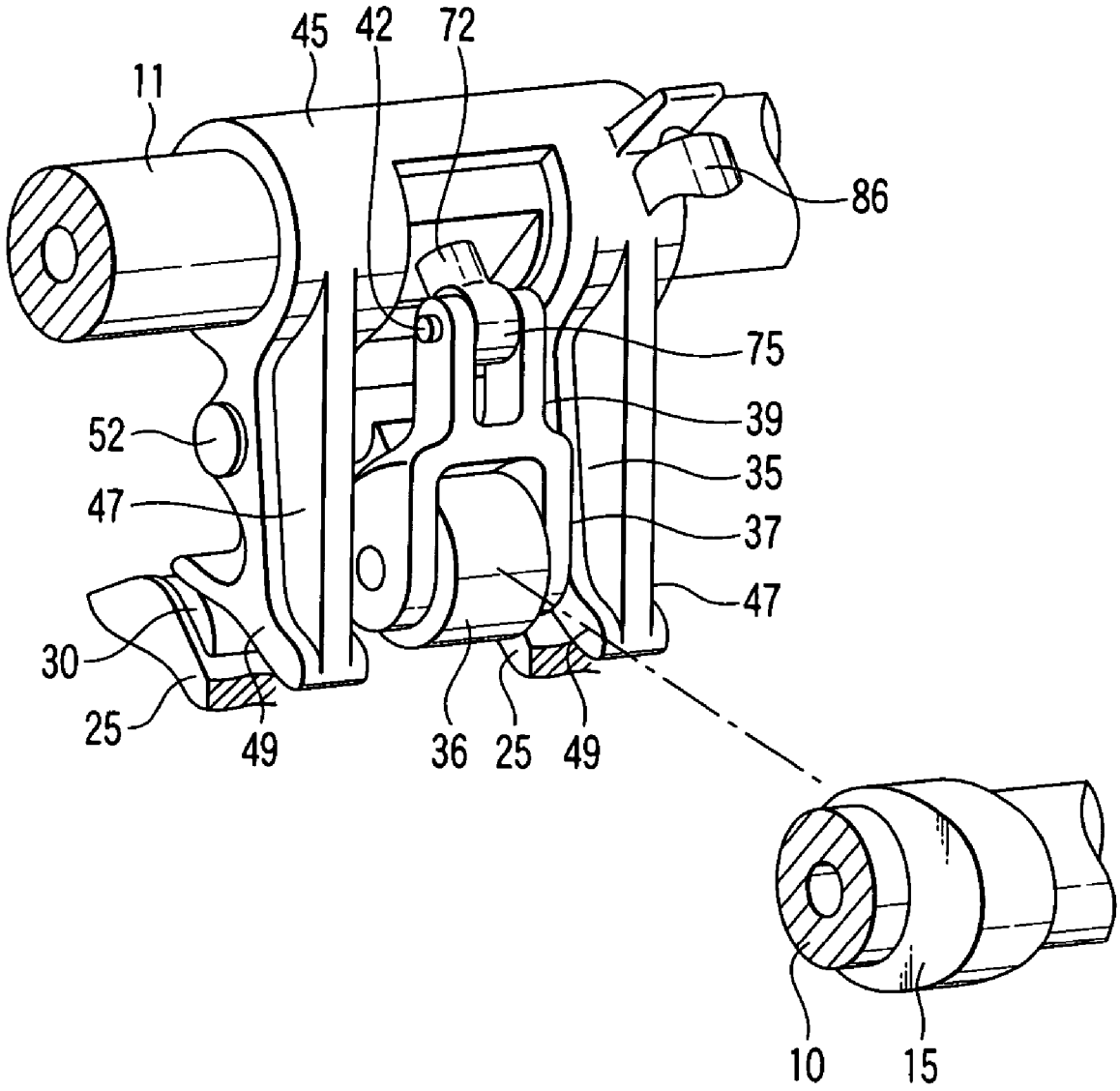
FIG. 10 is a perspective view showing the external appearance of a substantial part of a variable valve apparatus of a second embodiment of the present invention.
Figure 11:
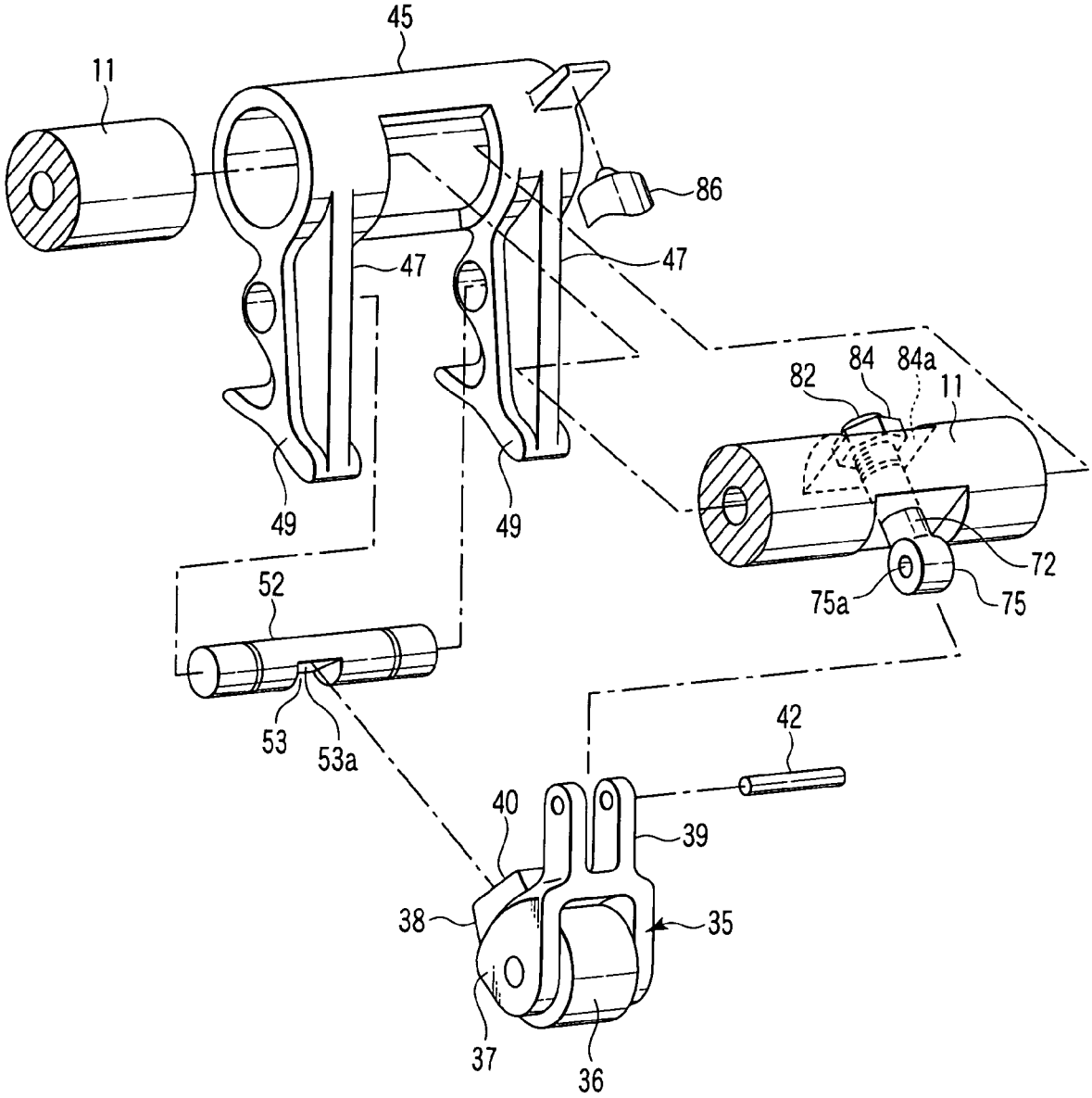
FIG. 11 is an exploded perspective view showing the variable valve apparatus shown in FIG. 10.

Consequently, as shown in A1 to A6 in FIG. 9, in the variable valve apparatus 20, the opening time of the intake valve 5 are substantially the same valve opening time as at the maximum valve lift moment from the high speed operation to the low speed operation of the engine. The valve closing time is largely changed and made variable continuously from the high speed operation to the low speed operation. As shown by the arrow-mark direction in FIG. 9, the variable ranges A1 to A6 of the variable valve apparatus 20 are further expanded at both the high valve lift A1 side and the low valve lift A6 side with the movement range (amount) of the center rocker arm 35 not changing. To be concert, valve lift volume of the high valve lift A1 side becomes large. Valve lift volume of the low valve lift A6 side becomes small.

Therefore, a higher valve lift amount than that at the case depending upon only the cam profile is secured, and further, a smaller valve lift amount is secured.

Accordingly, without need to change the intake cam 15 or change the movement range of the center rocker arm 35, the variable range of the intake valve 5 is expanded at both the high and low valve lift sides by a simple structure in which only the layout of the center rocker arm 35 is set.

Moreover, at the low valve lift control moment, the oscillation of the swing cam 45 while the valve is not lifted is energized by the spring load of the pusher 86. Accordingly, the oscillation angle of the swing cam 45 becomes small, so that the inertia of the swing cam 45 is suppressed small. Therefore, it is possible to set small the spring load of the pusher 86, and also it is possible to attain friction reduction, namely, fuel consumption improvement, and to make the spring size compact, namely, space-saving.

In particular, for the structure to transmit the cam displacement from the center rocker arm 35 to the swing cam 45, a configuration is employed in which the displacement of the cam from the center rocker arm 35 transmits to the swing cam 45 while sliding between the center rocker arm 35 and the swing cam 45. Thus, the input point S3 of the swing cam 45 is determined at a constant position.

As a consequently, as shown in FIGS. 5 and 7, a distance L from an oscillating fulcrum S4 of the swing cam 45 to the input point S3 of the swing cam 45 can be made constant in any variable control state, so that it is easy to lay out the center rocker arm 35 so as to establish a relation of B1/A1 value (θ1)>B2/A2 value (θ2).

Further, since the B1/A1 value (θ1) at the high valve lift control moment is set so as to satisfy α1>1, the oscillation angle of the swing cam 45 becomes larger than in the case depending upon only the cam profile of the intake cam 15. Furthermore, at the high valve lift control moment, a higher valve lift amount is secured.

Next, a variable valve apparatus of an internal combustion engine according to a second embodiment of the present invention will be illustrated with reference to FIGS. 10 to 13. The same functional components as those in the first embodiment are denoted by the same reference numerals, and the detailed description thereof is omitted.

In the present embodiment, the invention is applied to a variable valve apparatus 20 suitable for a Double Overhead Camshaft (DOHC) type valve operating system, for example. Note that the DOHC type valve operating system has a structure having a cam shaft exclusive for the intake side and another cam shaft exclusive for the exhaust side. The variable valve apparatus 20 adopted to the DOHC type valve operating system is substantially same in structure as that in the first embodiment except that only layouts of components are different from those of the first embodiment.

Namely, for the variable valve apparatus 20 shown in FIGS. 10 to 13, there are employed a structure in which a center rocker arm 35 is arranged on the side of a cam shaft 10 having an intake cam 15; a structure in which a cam follower 36 of the center rocker arm 35 is brought in rotary contact with to the intake cam 15 from the side; a structure in which a rocker shaft 11 is arranged on the side of the center rocker arm 35; a structure in which the center rocker arm 35 is oscillatably supported by the rocker shaft 11 by use of a control arm 72, a screw member 82 and a lock nut 84; a structure in which a swing cam 45 is oscillatably supported by the rocker shaft 11 with a cam surface 49 downward; a structure in which a rocker arm 25 for driving the intake valve 5 is arranged under the cam surface 49 of the swing cam 45; a structure in which the cam surface 49 is brought in rotary contact with a roller member 30 of the rocker arm 25; and a structure in which a gradient surface 40 formed on the side portion of the center rocker arm 35 is made to bump into a receiving surface 53*a* of a short shaft 52 of the swing cam 45 and the displacement of the cam transmitted via the center rocker arm 35 is transmitted to the swing cam 45 while making the receiving surface 53*a* and the gradient surface 40 slide. Note that reference numeral 90 denotes, for example, a hydro type rush adjuster.

Figure 12:
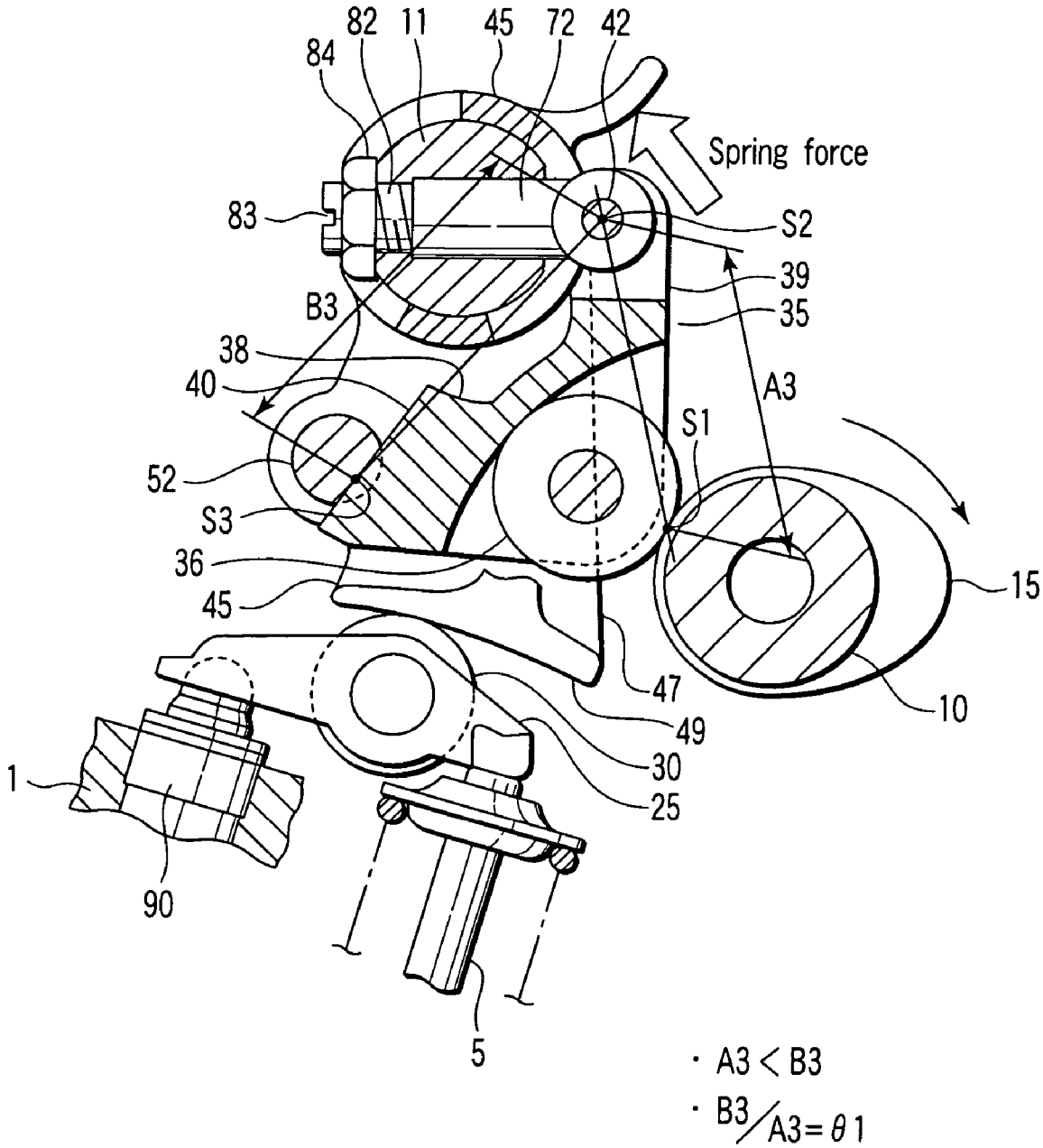
FIG. 12 is a cross sectional view of the variable valve apparatus shown in FIG. 10, showing a state where a rocker arm contacts a base circular zone of a cam surface at a high valve lift control.
Figure 13:
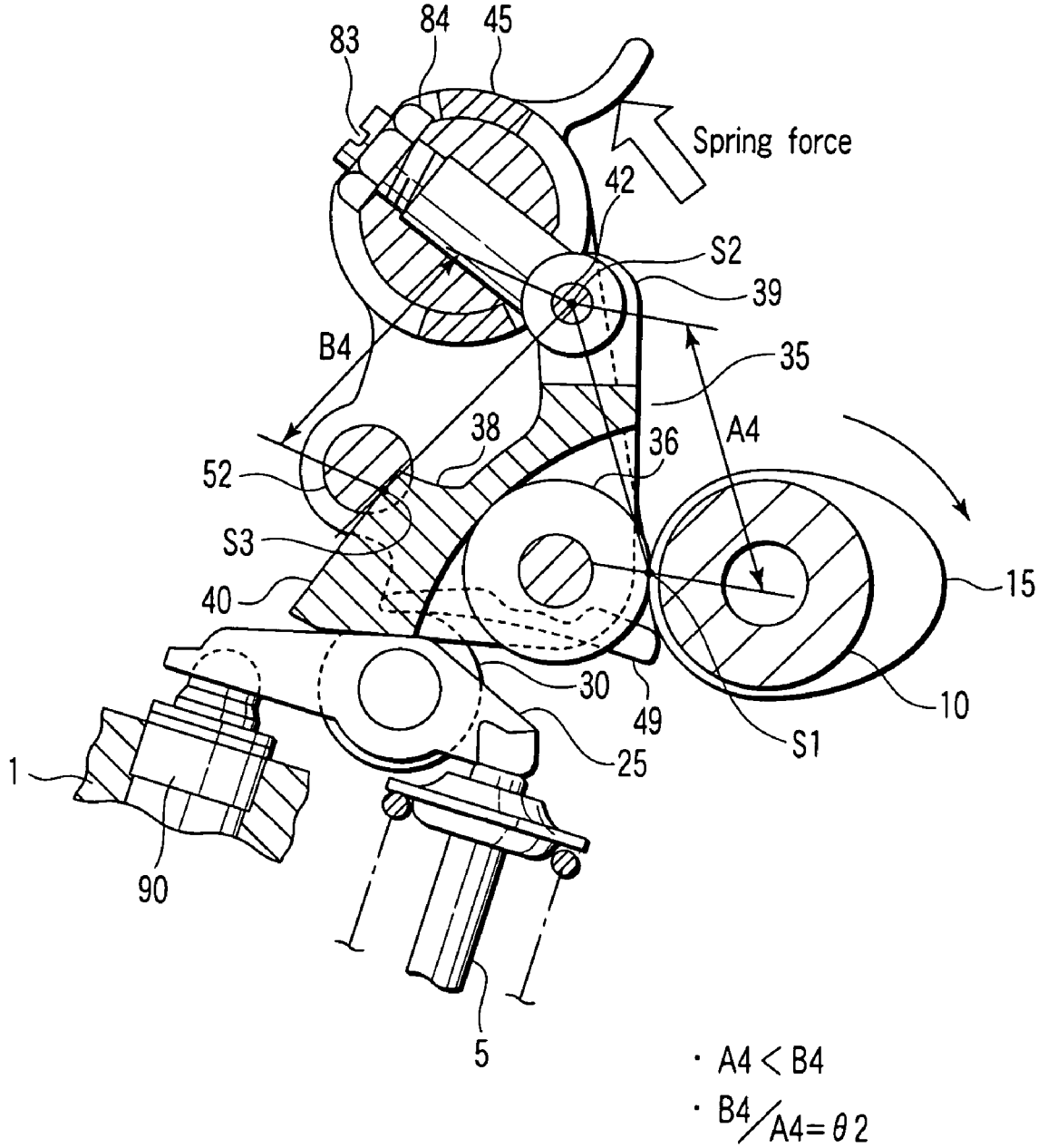
FIG. 13 is a cross sectional view of the variable valve apparatus shown in FIG. 10, showing a state where the rocker arm contacts a base circular zone of a cam surface at a low valve lift control.

In the variable valve apparatus 20 of such a configuration, for example, the center rocker arm 35 is arranged such that a relation of θ1>θ2, namely, a B3/A3 value>a B4/A4 value is established when, at the high valve lift control moment as shown in FIG. 12, a B3/A3 value is defined as θ1 (>1) wherein A3 is a distance between the contact point S1 to the oscillating fulcrum S2, and B3 is a distance from the oscillating fulcrum S2 to the point of action S3, and at the low valve lift control moment as shown in FIG. 13, a B4/A4 value is defined as θ2 wherein A4 is a distance between the contact point S1 to the oscillating fulcrum S2, and B4 is a distance from the oscillating fulcrum S2 to the point of action S3.

By the setting mentioned above, the same effects as those in the first embodiment can be attained. In particular, when the relation of A3<B3, A4>B4 is established as in the present embodiment, it is easy to expand the variable range in particular, at the low valve lift side.

Now, with reference to FIGS. 14 and 15, a variable valve apparatus according to a third embodiment of the present invention will be described. Note that the configurations having the same functions as those in the first embodiment are denoted by the same reference numerals and the description thereof is not repeated.

In the present embodiment, it is difference that the variable valve apparatus 20 is provided at the exhaust side. Other structures may be the same as those in the first embodiment. The difference will be described in detail.

Figure 14:
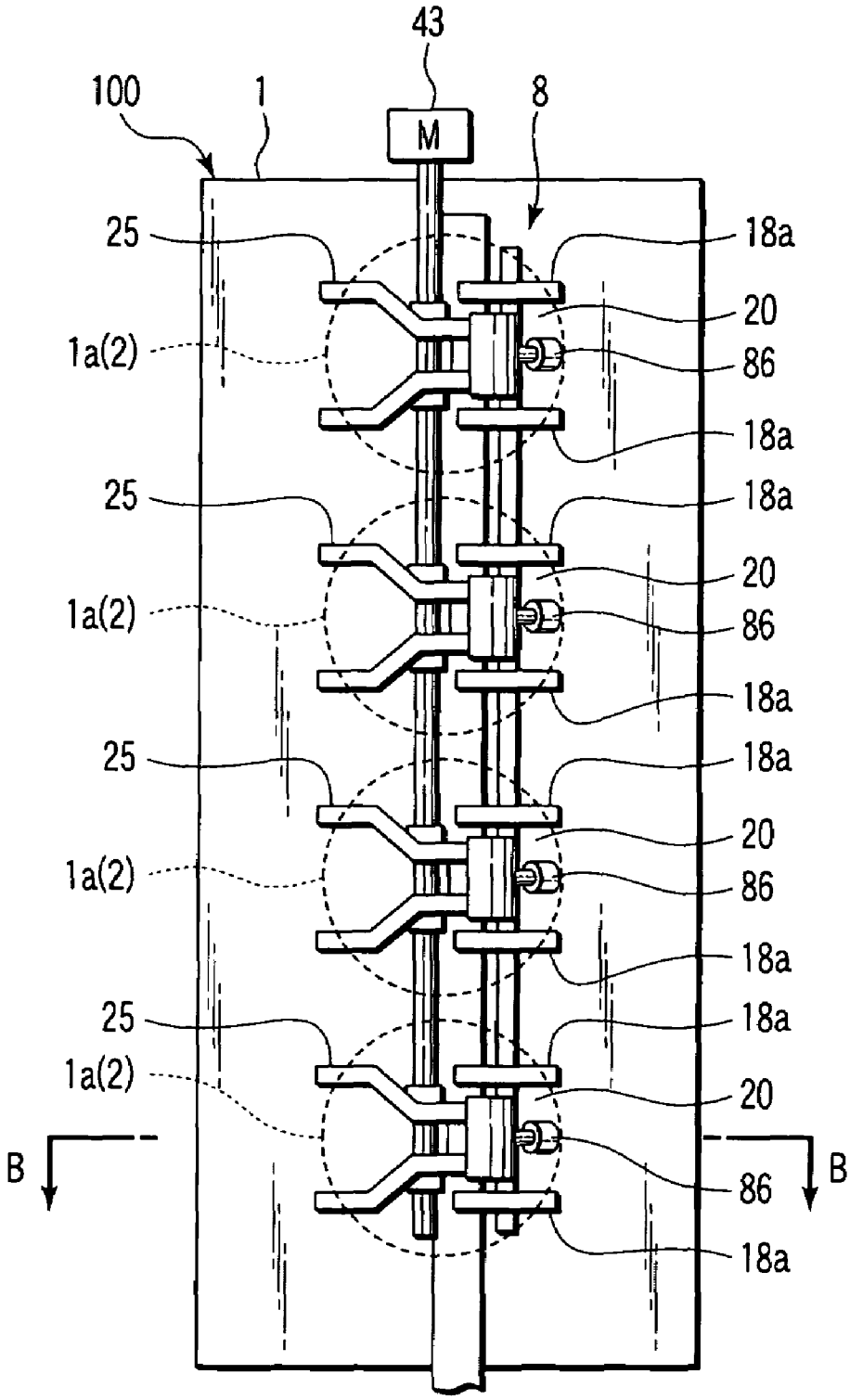
FIG. 14 is a plan view showing a cylinder head having, mounted on it, a variable valve apparatus according to a third embodiment of a present invention.

FIG. 14 is a plan view of a cylinder head 1 mounted the variable valve apparatus 20 according to this embodiment. FIG. 15 is a cross sectional view of the cylinder head 1 and the variable valve apparatus 20 taken along line B—B shown in FIG. 12.

Figure 15:
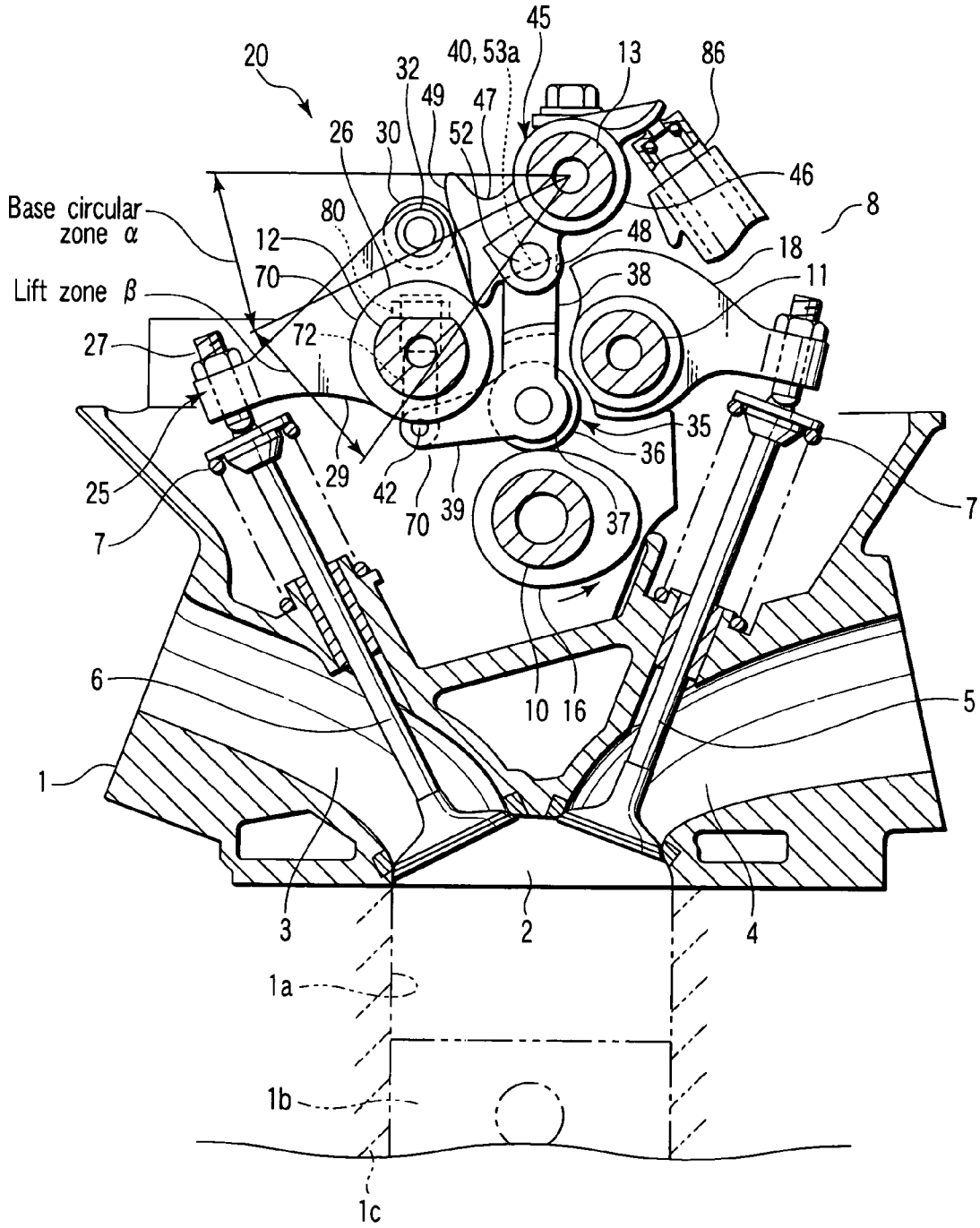
FIG. 15 is a cross sectional view taken along line B—B in FIG. 12 showing the variable valve apparatus and the cylinder head.

As shown in FIGS. 14 and 15, rocker shaft 12 of the exhaust side is provided the variable valve apparatus 20 per the pair of the exhaust cam 16, that is, the pair of the exhaust valve 6. The a rocker arm 18*a* for the intake is rotatably supported by the rocker shaft 11 of the intake valve 15 per intake cam 15, that is intake valve 15. The present embodiment can also provides the same advantageous effects as those provided by the first embodiment.

Note that the present invention is not limited to the first and second embodiments described above, and the present invention may be embodied in other specific forms without departing from the spirit or essential characteristics thereof. For example, in the above embodiment, the structure is employed in which the rocker shaft at the intake side is used also as the control shaft. However, a structure may be made in which a control shaft is employed separately.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve apparatus of an internal combustion engine, comprising:

a cam shaft rotatably provided in the internal combustion engine;

a cam formed on the cam shaft;

an oscillating cam provided oscillatably in the internal combustion engine, and having a cam surface which drives an intake valve or an exhaust valve; and a transmission arm oscillatably supported in the internal combustion engine and interposed between the oscillating cam and the cam, the transmission arm controlling valve characteristics of the intake valve or the exhaust valve by a change of a position to contact the cam and transmitting the displacement of the cam to the oscillating cam, the transmission arm being laid out such that, when a distance from a contact point between the cam and the transmission arm to an oscillating fulcrum of the transmission arm is defined as A, and a distance from the oscillating fulcrum of the transmission arm to a point of action of the transmission arm is defined as B to thereby determine a B/A value, θ1 as a B/A value at the time of a high valve lift control for controlling the valve lift characteristics, and θ2 as a B/A value at the time of a low valve lift control for controlling the valve lift characteristics establish a relation of θ1>θ2.

2. A variable valve apparatus of an internal combustion engine, according to claim 1, wherein the point of action of the transmission arm becomes the contact point between the oscillating cam and the transmission arm, and the distance B from the oscillating fulcrum of the transmission arm to the contact point between the oscillating cam and the transmission arm becomes longer at the high valve lift control than at the low valve lift control.

3. A variable valve apparatus of an internal combustion engine, according to claim 1, wherein the transmission arm transmits the displacement of the cam to the oscillating cam while the cam slides with the oscillating cam.

4. A variable valve apparatus of an internal combustion engine, according to claim 2, wherein the transmission arm transmits the displacement of the cam to the oscillating cam while the cam slides with the oscillating cam.

5. A variable valve apparatus of an internal combustion engine, according to claim 1, wherein the θ1 as a B/A value at the high valve lift control satisfies θ1>1.

6. A variable valve apparatus of an internal combustion engine, according to claim 2, wherein the θ1 as a B/A value at the high valve lift control satisfies θ1>1.

* * * * *